US005769039A

United States Patent [19]

Taue et al.

[11] Patent Number: 5,769,039

[45] Date of Patent: Jun. 23, 1998

[54] V SHAPED MULTI-CYLINDER ENGINE OF CRANKCASE COMPRESSION TYPE

[75] Inventors: Jun Taue; Masahisa Kuranishi, both of Iwata, Japan

[73] Assignee: Yamaha Hatsudoki Kabushiki Kaisha, Iwata, Japan

[21] Appl. No.: 868,711

[22] Filed: Jun. 4, 1997

[30] Foreign Application Priority Data

Jun. 4, 1996 [JP] Japan ..... 8-141872

[51] Int. Cl.[6] ..... F02B 75/02

[52] U.S. Cl. ..... 123/52.4; 123/317; 123/54.4

[58] Field of Search ..... 123/52.4, 317, 123/318, 54.4

[56] References Cited

U.S. PATENT DOCUMENTS

| | | | |
|---|---|---|---|
| 2,634,711 | 4/1953 | Pielstick | 123/52.4 |
| 3,859,968 | 1/1975 | Stinebaugh | 123/317 |
| 4,787,344 | 11/1988 | Okumura et al. | 123/54.4 |
| 5,438,963 | 8/1995 | Tsunoda et al. | 123/54.4 |
| 5,513,601 | 5/1996 | Benson | 123/54.4 |
| 5,564,380 | 10/1996 | Kobayashi et al. | 123/54.4 |
| 5,617,821 | 4/1997 | Tsunoda et al. | 123/54.4 |
| 5,623,895 | 4/1997 | Masuda et al. | 123/54.4 |
| 5,673,655 | 10/1997 | Mishima | 123/54.4 |
| 5,678,525 | 10/1997 | Taue | 123/317 |

*Primary Examiner*—David A. Okonsky
*Attorney, Agent, or Firm*—Knobbe, Martens, OLson & Bear LLP

[57] ABSTRACT

A multi-cylinder engine of a crankcase compression type shown for use in an outboard motor. The engine has a very compact V type arrangement. The intake system for admitting the charge to the crankcase chambers and the exhaust manifold is located in the valley between the cylinder banks. The compressor delivery to the cylinder head intake ports is on the outside of the engine.

18 Claims, 8 Drawing Sheets

V SHAPED MULTI-CYLINDER ENGINE OF CRANKCASE COMPRESSION TYPE

BACKGROUND OF THE INVENTION

This invention relates to an internal combustion engine and more particularly to an improved high performance, compact, V type, multi-cylinder engine of a crankcase compression type.

A wide variety of systems employ two-cycle internal combustion engines as their power plants. One reason why two-cycle engines are utilized for these applications is because of their high specific output and relatively compact size. For example in substantially all watercraft applications, particularly those of the smaller type of pleasure craft and utility craft, the space available for the engine is quite restricted. Therefore, it is desirable to be able to utilize an engine that has high specific output and a compact configuration. This is particularly true in connection with outboard motors. As is well known, with an outboard motor the engine is positioned in the powerhead and the outboard motor is normally mounted in the transom of the watercraft which it propels. This obviously requires a compact power plant.

The compact and simple nature of two-cycle engines, however, gives rise to certain problems. Because of the scavenging system employed and the inherent overlap in the port timing, it is more difficult to control the exhaust emissions with two-cycle engines, particularly when the engine runs over a wide variety of speeds and loads. In addition, the lubricating system employed with two-cycle engines can, at times, also give rise to emission problems.

Therefore, there is an increasing desire to substitute four-cycle engines for two-cycle engines in watercraft propulsion systems. This trend is arising not only in outboard motors but also in the power plants for small watercraft such as personal watercraft that have also normally used two cycle engines. However, these applications do require compact engines and engines that provide high power outputs for their size.

It is, therefore, a principal object of this invention to provide an improved and compact power plant arrangement.

It is a further object of this invention to provide an improved, compact and yet high output engine that can be utilized for marine propulsion.

It is a still further object of this invention to provide an improved high output compact four-cycle internal combustion engine and watercraft propulsion system utilizing such an engine.

An engine which has the capability of providing high specific output is disclosed in U.S. Pat. No. 5,377,634 entitled "Compressor System For Reciprocating Machine", issued Jan. 3, 1995 in the name of the one of the inventors hereof and which application is assigned to the Assignee hereof. In that patent, however, the engine has a relatively large overall dimension even though it provides a high power output for its displacement. Also, that patent illustrates only a single cylinder engine and in many applications, multiple cylinder engines are desirable.

It is, therefore, a still further object of this invention to provide an improved engine of the type shown in that patent that it has a compact induction and exhaust system and which employs multiple cylinders.

In many applications and particularly those employed in watercraft propulsion systems, a V-type configuration is employed for the engine in order to provide a more compact power unit. With the type of engine shown in the aforenoted U.S. Pat. No. 5,377,634, the intake charge is delivered to the crankcase chambers for compression at one side thereof. The compressed charge is delivered to a plenum chamber at the other side of the engine which supplies the intake ports of the engine through intake passages formed in the cylinder head. In addition, an exhaust manifold is also required to collect the exhaust gases and deliver them to the atmosphere. Obviously, these added components and their positions can present problems in conjunction with installation in a marine propulsion system.

It is, therefore, a still further object of this invention to provide an improved engine of the type shown in that patent that it has a compact induction and exhaust systems and which employs multiple cylinders in a V type configuration..

SUMMARY OF THE INVENTION

This invention is adapted to be embodied in a four cycle, V type, internal combustion engine comprised of a pair of cylinder blocks disposed at a V angle to each other and forming a valley therebetween. Each of the cylinder blocks has at least one cylinder bore. A crankcase is formed at one end of the cylinder bores and forms a plurality of crankcase chambers each associated with a respective cylinder bore. Each of pair of cylinder heads close the other end of a respective one of the cylinder blocks. A plurality of pistons each reciprocating in a respective one of said cylinder bores and forming with said cylinder bores and the cylinder heads a plurality of combustion chambers. Crankshaft means are rotatably journalled in the crankcase. A plurality of connecting rods each couple a respective one of the pistons and the crankshaft means for transmitting motion therebetween. Means for providing a seal so that the pistons, the cylinder bores, the connecting rods, the crankshaft means and the crankcase chambers acting as a plurality of positive displacement pumps. Intake means admit an air charge to the crankcase chambers in the valley. Delivery means discharge a compressed air charge from the crankcase chambers at the other side of said valley. Each of a pair of compressor chambers are located at the other sides of the valley for receiving the compressed charge from the respective crankcase chamber. Each of the cylinder heads have at least one intake port on the other side of the valley for serving the respective of the combustion chambers. Means supply a compressed charge from the respective compressor chamber to the respective intake port entirely located on said other side of the valley. At least one exhaust passage is formed in each of the cylinder heads contiguous to the valley for discharging exhaust products from the combustion chambers. An exhaust manifold is provided at least in part in the valley for collecting the exhaust gasses from the exhaust passages.

DETAILED DESCRIPTION OF THE PREFERRED EMBODIMENTS OF THE INVENTION

Figure 1:
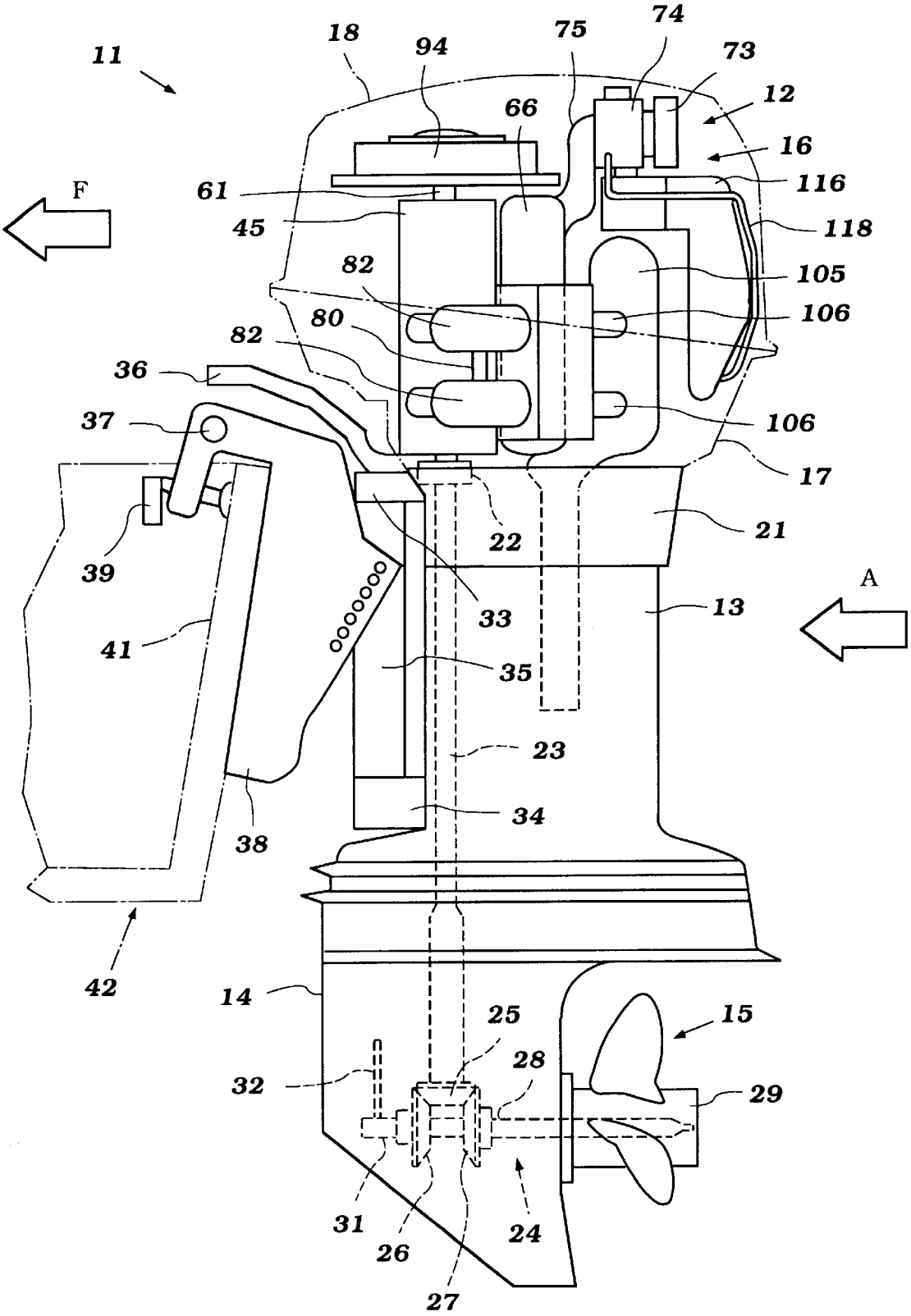
FIG. 1 is a side elevational view of an outboard motor constructed in accordance with a first embodiment of the invention shown attached to the transom of a watercraft, illustrated partially and in phantom.
Figure 2:
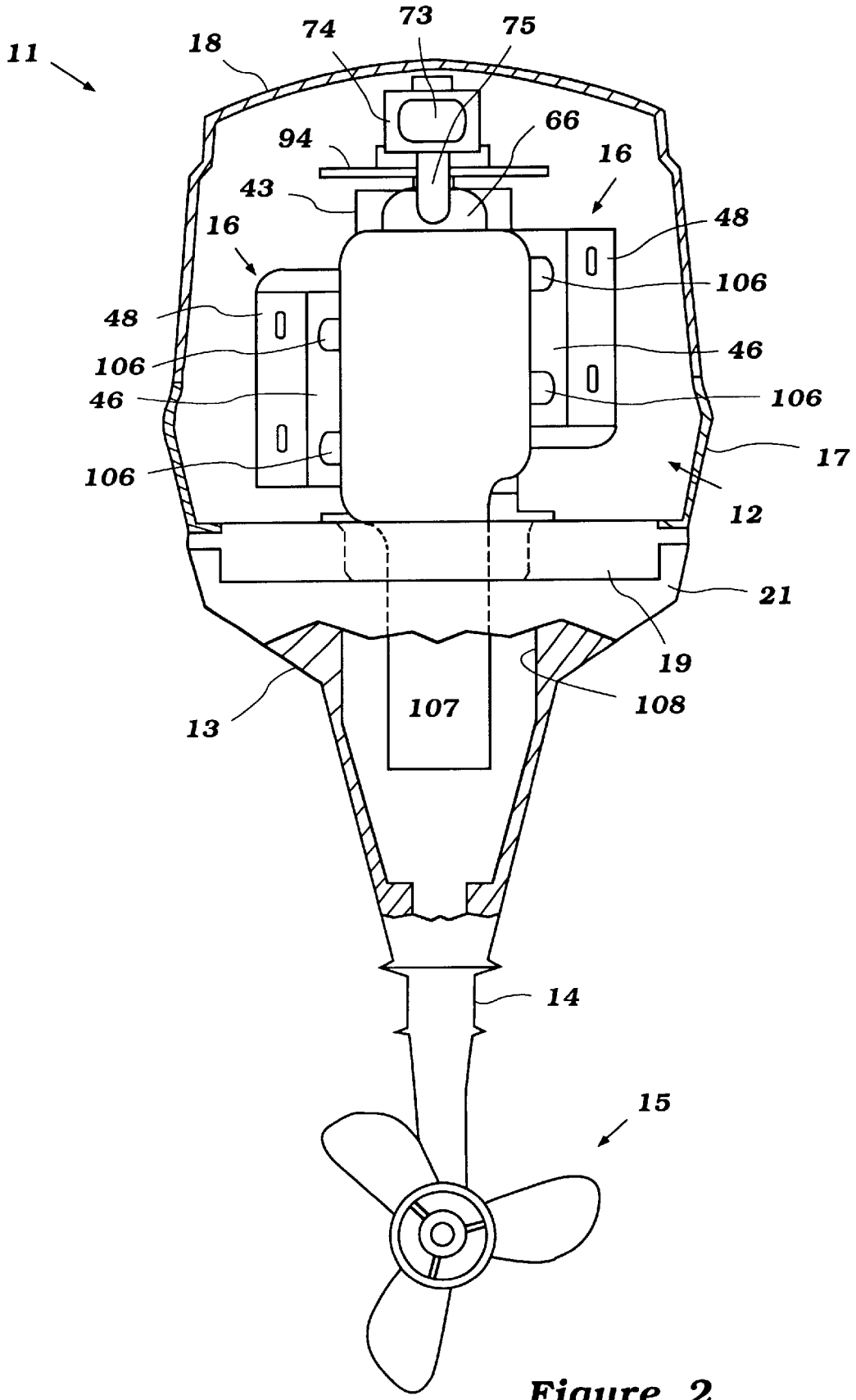
FIG. 2 is a rear elevational view of the outboard motor looking in the direction of the arrow A in FIG. 1 with portions broken away so as to more clearly show the construction.
Figure 3:
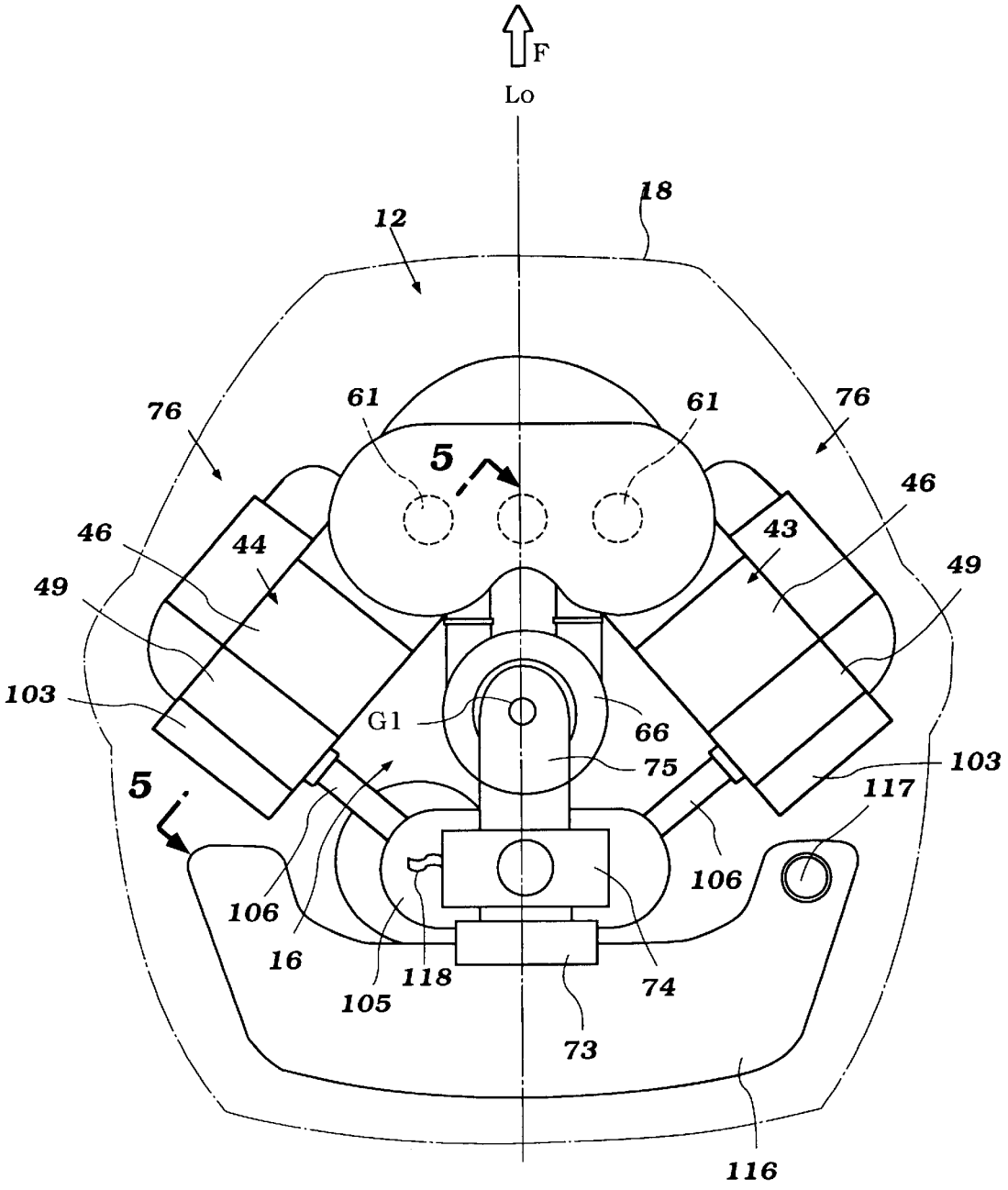
FIG. 3 is an enlarged top plan view of the powerhead of the outboard motor with the engine shown in solid lines and the protective cowling shown in phantom.
Figure 4:
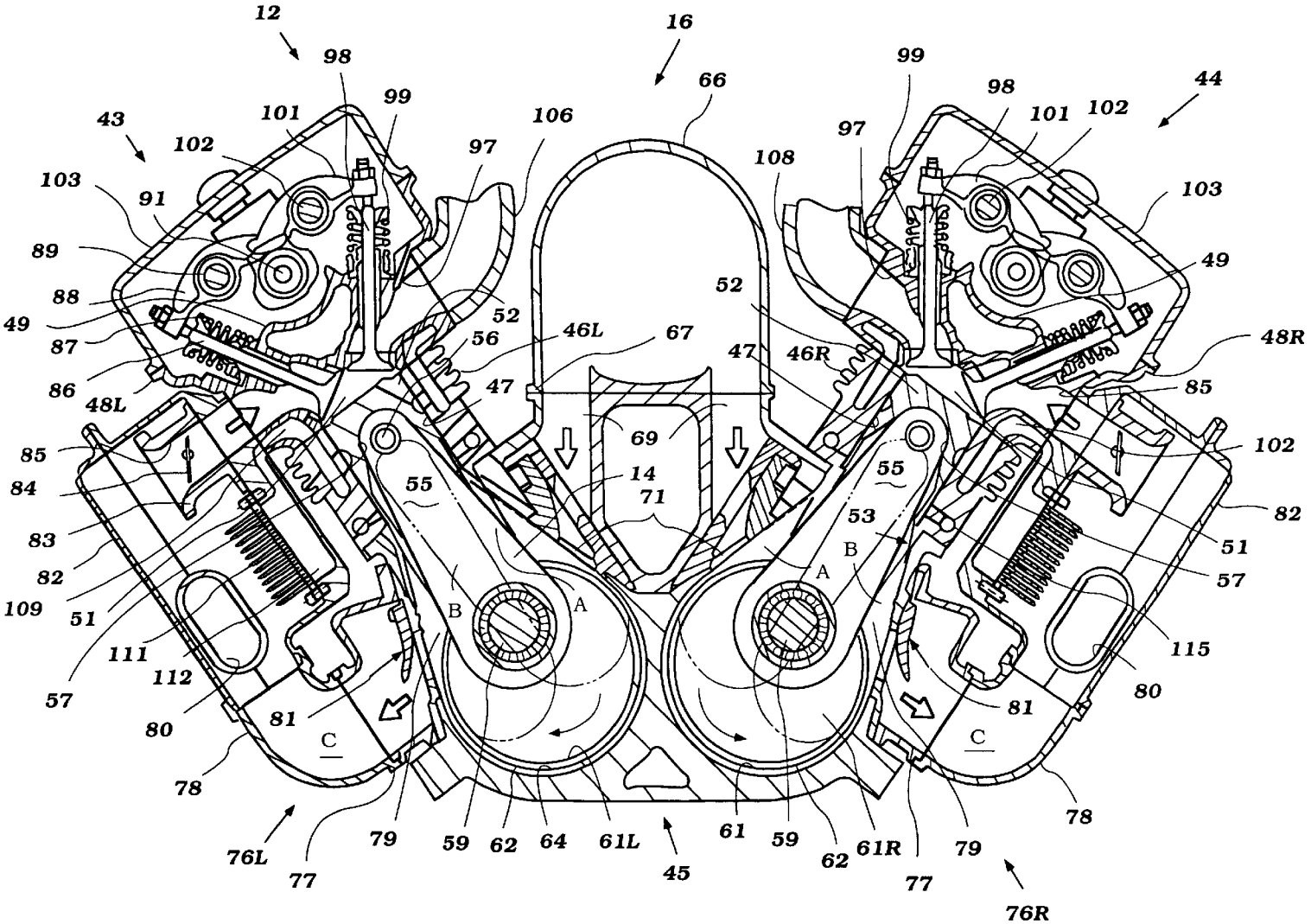
FIG. 4 is a cross-sectional view taken through the engine along a horizontal plane.
Figure 5:
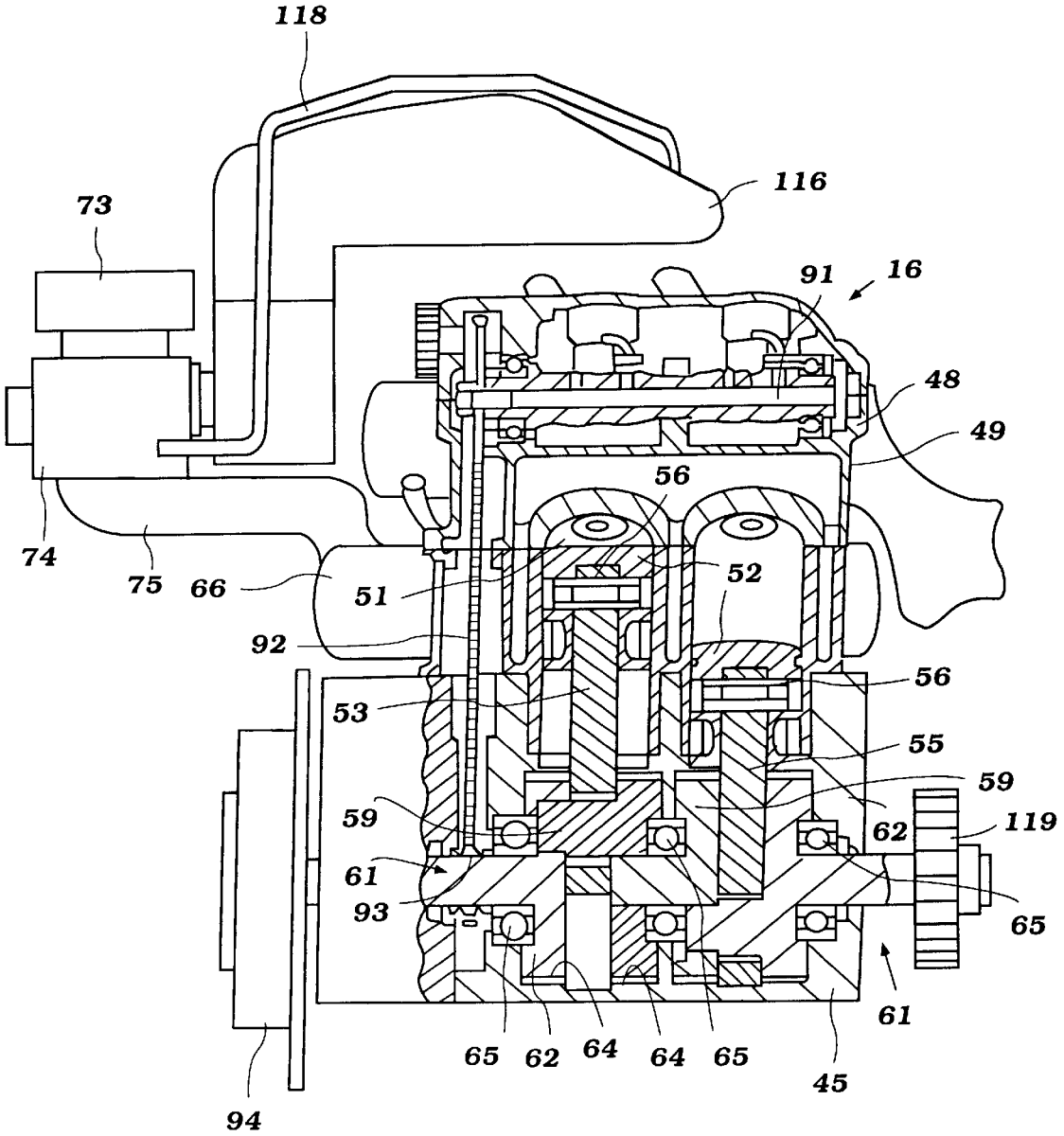
FIG. 5 is an enlarged cross-sectional view taken along the line 5—5 of FIG. 3.
Figure 6:
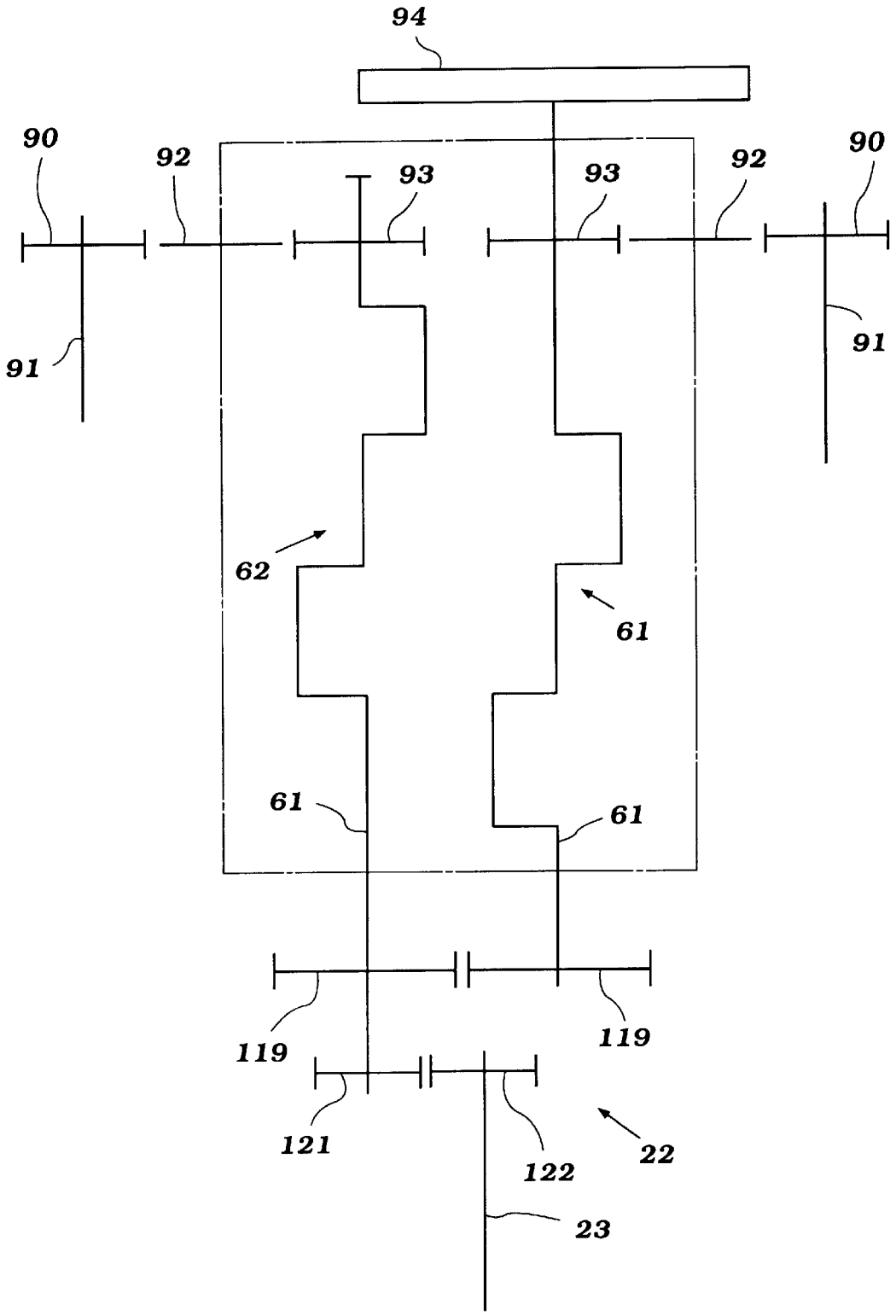
FIG. 6 is a schematic view showing how the two crankshafts of this embodiment are coupled to each other and are coupled for driving relationship to the drive shaft.

Referring first to the embodiment of the invention as shown in FIGS. 1–6 and initially primarily to FIGS. 1 and 2, an outboard motor constructed in accordance with this embodiment is indicated generally by the reference numeral 11. The invention is described in such an environment because it provides a compact, high specific output power plant as is required for outboard motors. As will be readily apparent to those skilled in the art, engines embodying the invention may be employed in other environments.

The outboard motor 11, as with most outboard motors, is comprised of a powerhead, indicated generally by the reference numeral 12, that is disposed above a drive shaft housing/lower unit assembly comprised of a drive shaft housing 13 and a lower unit 14.

A propulsion device such as a propeller 15 is supported in the lower unit 14 in a manner to be described and is driven by an internal combustion engine embodying the invention, indicated generally by the reference numeral 16 which forms a major portion of the powerhead 12.

The powerhead 12, in addition to the engine 16, is comprised of a protective cowling that is comprised primarily of a lower tray portion 17 and an upper main cowling portion 18 that is detachably connected to the tray portion 17 in any known manner. The tray portion 17 is typically formed from a relatively high strength lightweight material such as aluminum or aluminum alloy. The main cowling portion 18, on the other hand, is formed from an even lighter weight but less strong material such as a molded fiberglass reinforced resin or the like.

As may be seen best in FIG. 2, the engine 16 is mounted on a spacer plate or exhaust guide 19 which is positioned in the upper end of the drive shaft housing 13. A shroud 21 may be formed around the upper portion of the drive shaft housing 13 and spacer plate 19 so as to provide a neater appearance and for sealing purposes.

As is typical without outboard motor practice, the engine 16 is supported within the powerhead 12 upon the spacer plate 19 so that its output shaft, to be described in more detail later, rotates about a vertically extending axis. This facilitates a coupling 22 of the output shaft or crankshaft to a drive shaft 23 which rotates about a generally vertically extending axis and which is journaled within the drive shaft housing 13 and lower unit 14.

In the lower unit 14, the drive shaft 23 drives a forward neutral reverse transmission, indicated generally by the reference numeral 24 and which may be of any known type. Basically, this transmission includes a driving bevel gear 25 that is fixed for rotation with the lower end of the drive shaft 23. This driving gear 25 drives a pair of diametrically opposed driven bevel gears 26 and 27 which rotate in opposite directions.

These driven bevel gears 26 and 27 are journaled on a propeller shaft 28 to which a hub 29 of the propeller 15 is affixed in a known manner. A dog clutching mechanism of a known type is provided for selectively coupling either the gear 26 or the gear 27 to the propeller shaft 28 so as to drive the propeller 15 in a forward or reverse direction. When this dog clutching element is positioned in a neutral position, the gears 26 and 27 rotate freely on the propeller shaft 28 and no propulsion is provided. This shifting is accomplished by means of a shift plunger 31 that is operated by a shift rod 32. The shift rod 32 extends upwardly to a shift control lever of any known type (not shown).

A steering shaft (not shown) is affixed to the drive shaft housing 13 by an upper bracket assembly 33 and a lower bracket assembly 34. This steering shaft is journaled for rotation in a swivel bracket 35 for steering of the outboard motor 11 in a known manner. A tiller 36 is affixed to the upper end of the steering shaft for steering of the outboard motor 11 in a well known manner.

The swivel bracket 35 is, in turn, pivotally connected by a pivot pin 37 to a clamping bracket 38. Pivotal movement about the pivot pin 37 permits tilt and trim movement of the outboard motor 11, as is also known in the art. A clamping mechanism 39 is carried by the clamping bracket 38 for detachably affixing the outboard motor 11 to a transom 41 of a watercraft hull, shown partially and indicated generally by the reference numeral 42.

The construction of the outboard motor 11 as thus far described may be considered to be conventional. Where any details of the outboard motor 11 are not described, those skilled in the art can readily resort to any known type of construction with which to practice the invention. The invention deals primarily with the construction of the internal combustion engine 16 and that now will be described by principal reference to FIGS. 3 through 6 although certain of the components also appear in FIGS. 1 and 2. Where that is the case, the reference numerals applied to them will be carried over into these earlier figures.

The engine 16 is, in the illustrated embodiment, of a four-cylinder V type. Although the invention is described in conjunction with a four-cylinder engine, it should be readily apparent to those skilled in the art that the invention may be utilized in conjunction with any multiple number of cylinders.

The engine 16 basically consists of a pair of cylinder banks 43 and 44 mounted on a common crankcase, indicated generally by the reference numeral 45. Each cylinder bank is comprised of a cylinder block, indicated by the reference numeral 46 and in which two horizontally disposed, vertically spaced, cylinder bores 47 are formed. At times the suffixes L and R will be used with the reference numerals to distinguish the components associated with the respective left and right cylinder banks.

One end of the cylinder bores 47 of each bank is closed by a respective cylinder head assembly, indicated generally by the reference numeral 48, which is detachably affixed, in the illustrated embodiment, to the cylinder block 46 in any known manner.

Each cylinder head assembly 48 includes a main cylinder head casting 49 that is formed with individual recesses 51 which cooperate with the cylinder bores 47 and pistons 52 that are slidably supported therein to form the combustion chambers of the engine. Because of the fact that the cylinder head recesses 51 form the major portion of the combustion chamber volume at top dead center, the reference numeral 51 will at times also be utilized to identify the combustion chambers.

The cylinder blocks 46 have cylindrical extensions 53 around the cylinder bores 47 that are received within complimentary openings 54 of the crankcase member 45. This crankcase member 45 is affixed to the cylinder blocks 46 in a known manner and functions, among other things, to close the ends of the cylinder bores 47 below the pistons 52. In the illustrated embodiments the V angle between the cylinder banks is 45°, although other angles are obviously possible depending on the specific application.

Connecting rods 55 are connected by piston pins 56 to the pistons 52. The pistons 52 are formed with recessed areas 57 that are engaged by the small ends of the connecting rods 55 so as to form a pivoting seal between the ends of the connecting rods 55 and the pistons 52 for a reason which will be described.

The lower or big ends of the connecting rods 55, indicated by the reference numeral 58 are journaled on throws 59 of a respective crankshaft 61. Adjacent each throw 59, the crankshaft 61 is formed with disk-like members 62 that cooperate with the interior surface of the crankcase member 45 so as to define a pair of side by side series of individual crankcase chambers 63 each of which is associated with a respective cylinder bore 47 of the respective cylinder bank 43 or 44. The chambers 63 associated with each cylinder bank 43 or 44 are basically sealed by sealing surfaces 64 disposed on opposite sides of each throw 59 and which cooperate with the crankshaft disk-like portions 62 to provide axial seals and to seal one crankcase chamber 63 from the other.

The crankshafts 61 are rotatably journaled in the crankcase member 45 about parallel axes by a plurality of main anti-friction bearings, indicated generally by the reference numeral 65. As described in the aforenoted U.S. Pat. No. 5,377,7634, the connecting rods 55 functions at times to divide the crankcase chamber 62 into a first, intake side A and a second, delivery side B. The crankshafts 61L and 61R rotate in opposite directions so that the intake sides A lie adjacent each other and on the valley side of the engine. The delivery sides B lie on the outer sides of the respective cylinder bank 43 and 44 from the valley. This is done to simplify the induction and exhaust systems, as will become apparent.

An air charge is delivered to the intake side A of each bank by an induction system which is placed in major portion in the valley of the engine 16. Basically, this induction system is comprised of a charging chamber 66 that is disposed substantially entirely in the valley between the cylinder banks 43 and 44.

The crankcase member 45 is formed on the valley side thereof with a portion which is surrounded by an outstanding flange 67. The charging chamber 66 is detachably affixed to the flange 67 of the crankcase member 55.

This charging chamber 66 communicates the crankcase intake sides A via intake passages 69 through flow ports 71. The flow ports 71 are actually valved by the connecting rods 55 which at times close a portion of the crankcase chamber part A during the down stroke of the pistons 52.

As is well known in the outboard motor art, the main cowling member 18 is provided with an atmospheric air inlet opening which does not appear in the figures but which permits intake air to be drawn into the protective cowling. This air is then delivered to an intake device, indicated generally by the reference numeral 73 which disposed conveniently adjacent the upper end of the valley in an otherwise void area. This intake device 73 may provide a silencing function and, in turn, delivers the air charge to one or more carburetors 74.

The carburetor 74 has conventional circuits and may be of any known type. It, in turn, delivers a fuel/air charge to the charging chamber 66 through an inter-fitting coupling or delivery tube 74. Thus, a fuel/air charge is drawn through the intake system 66 into the crankcase chambers 63 during the upstroke of the pistons 52 much like in a two-cycle crankcase compression engine.

The charge which is drawn into the crankcase chambers 63 is trapped in the delivery side B when the connecting rods 55 and pistons 52 move toward their bottom dead center positions. They then act to compress the charge and deliver it to a pair of delivery systems, each of which is indicated generally by the reference numeral 76 and which are disposed in totality on the other side of the respective cylinder banks 43 and 44 from the valley and the charging chamber 66.

Each delivery system is comprised of two parts, one for each cylinder bore 47 and its combustion chamber 51 which functions much like a plenum chamber. Each plenum chamber, designated at C is formed by a recess formed in an outer portion 77 of the crankcase member 55 and which is closed on its outer surface by a closure plate 78.

A compressor port 79 is formed in the side of the crankcases member 55 communicating with this chamber C and is valved by the respective connecting rod 55 and a reed type valve assembly 81 so as to ensure trapping of the compressed charge in the chamber C.

A pair of intake pipes, indicated by the reference numeral 82 extend from within each of the compressor chambers C and curve along the deliver sides 76 of the engine and terminate in a throttle body assembly 83. Each throttle body assembly 83 includes a butterfly-type throttle valve 84 that control the flow of charge to a respective intake passage 85 formed on this same side of the engine 16. The throttle valves 84 are controlled by a remote throttle actuator in any known manner. The intake pipes of each bank are connected by balance passages 80.

The intake passages 85 terminate at intake ports that are valved by intake valves 86 that are slidably supported in the respective cylinder head member 49 in a known manner. Coil compressions springs 87 hold these intake valves 86 in their closed position. Intake rocker arms 88 are journaled in the respective cylinder head assembly 48 on intake rocker arm shaft 89. These rocker arms 88 are operated by the intake cams of a camshaft 91 that is journaled for rotation in the respective cylinder head assembly 49.

The camshafts 91 are driven at one-half crankshaft speed by a timing chain 92 (FIGS. 5 and 6) that is engaged with a sprocket 90 fixed to the upper end of the camshaft 91 and a sprocket affixed to the upper end of the respective crankshaft 61, which sprocket is indicated by the reference numeral 93. Hence, the charge which has been compressed in the crankcase chamber and stored in the compression chamber C will be delivered under pressure into the combustion chambers 51 when the intake valves 86 open on the intake stroke.

This charge will be further compressed in as the pistons 52 move toward their top dead center position on the compression stroke. The charge is then fired by spark plugs (not shown) that are mounted in the respective cylinder head assembly 48 by means of an ignition system which may include flywheel magneto assembly 94 that is driven off of the upper end of one of the crankshafts 61 and is connected for rotation therewith.

The charge which is ignited by the spark plugs will burn and expand to drive the pistons 52 in a well known manner during the power stroke. During the exhaust stroke, the charge is discharged from the combustion chambers 51 through exhaust ports formed on the valley side of the cylinder heads opposite to the intake passages 85 and which communicate with exhaust passages 97.

These exhaust ports are valved by exhaust valves 98 which are normally urged to a closed position by coil compression springs 99. These exhaust valves 98 are opened by exhaust rocker arms 101 journaled on an exhaust rocker arm shaft 102 that is mounted in the cylinder head assembly 48. These exhaust rocker arms 101 are operated by exhaust cam lobes formed on the camshaft 91.

The valve actuating mechanism thus far described is contained within a valve actuating chamber that is closed by a cam cover 103 that is affixed to the respective cylinder head casting 49 and which completes the cylinder head assembly 48.

The exhaust gases that are discharged from the cylinder head passages 97 are delivered to an exhaust manifold assembly, indicated generally by the reference numeral 104. The exhaust manifold assembly 104 is positioned entirely on the valley side of the engine 16 and is adjacent but spaced from the intake system 66. This exhaust manifold assembly 104 includes a collector section 105. Individual runner pipes 106 extend from each exhaust passage 97 of each cylinder head to the collector section 105.

The manifold 104 extends downwardly and terminates in a discharge end 107 that extends into an expansion chamber 108 formed in the drive shaft housing 13. The exhaust gasses are discharged to the atmosphere from this expansion chamber 108 through a suitable discharge system which may include a through-the-propeller hub underwater discharge and a more restricted above-the-water low speed discharge. Such systems are well known in the art and since they form no significant part of the invention, further description is not believed to be necessary.

The engine 16 is water cooled and water for its cooling is drawn from the lower unit 14 by a water pump driven off of the lower end of the drive shaft 23 in a well known manner. The cylinder block 46 and cylinder head 49 are formed with cooling jackets 109 through which this water is circulated. In addition, each compressor chamber C is formed in part by a fined plate 111 that cooperates with the exterior of the cylinder blocks 46 along with other portions defining the chamber C to form a further intercooler jacket 112. Coolant is circulated through the cooling jacket 112 from the engine cooling jacket 109 so as to cool the intake charge and to act, in effect, as an inter-cooler.

The engine 16 is also provided with a lubricating system which may include a four-cycle type of lubricating system that delivers lubricant to the piston 52 through the walls of the cylinder blocks 46 for examples through delivery ports 115.

In addition, a two-cycle type oil tank, indicated generally by the reference numeral 116 and having a fill cap 117, may be positioned in the powerhead 112 in a space location relative to the exhaust manifold collector section 105. This tank 116 is provided with a line 118 that extends to a point in the carburetor 74 where a venturi action will effect to draw lubricant from the tank 116 and mix it with the inducted air and fuel for lubricating the crankshafts 61 and their bearings with a two-cycle type lubricating system.

As may be seen, the construction of the engine and the positioning of the components is such so that the center of gravity G1 will be disposed fairly centrally of the powerhead 12. In this embodiment, the crankshafts 61 have their rotational axes offset from the drive shaft 23. In order to provide timing between the two crankshafts 61 and to accommodate driving of the drive shaft 23, a transmission mechanism is provided that is shown in most detail in FIG. 6. This transmission mechanism includes a first pair of intermeshing gears 119 that are affixed to the lower ends of the two crankshafts 61 and which will maintain rotation of the crankshafts 61 in time due to their opposite rotation.

In addition, the crankshaft 61 has affixed to it a timing gear 121 which forms a portion of the aforenoted coupling 22 for driving the drive shaft 23. This gear 121 is enmeshed with a second gear 122 that is affixed to and drives the upper end of the drive shaft 23.

Figure 7:
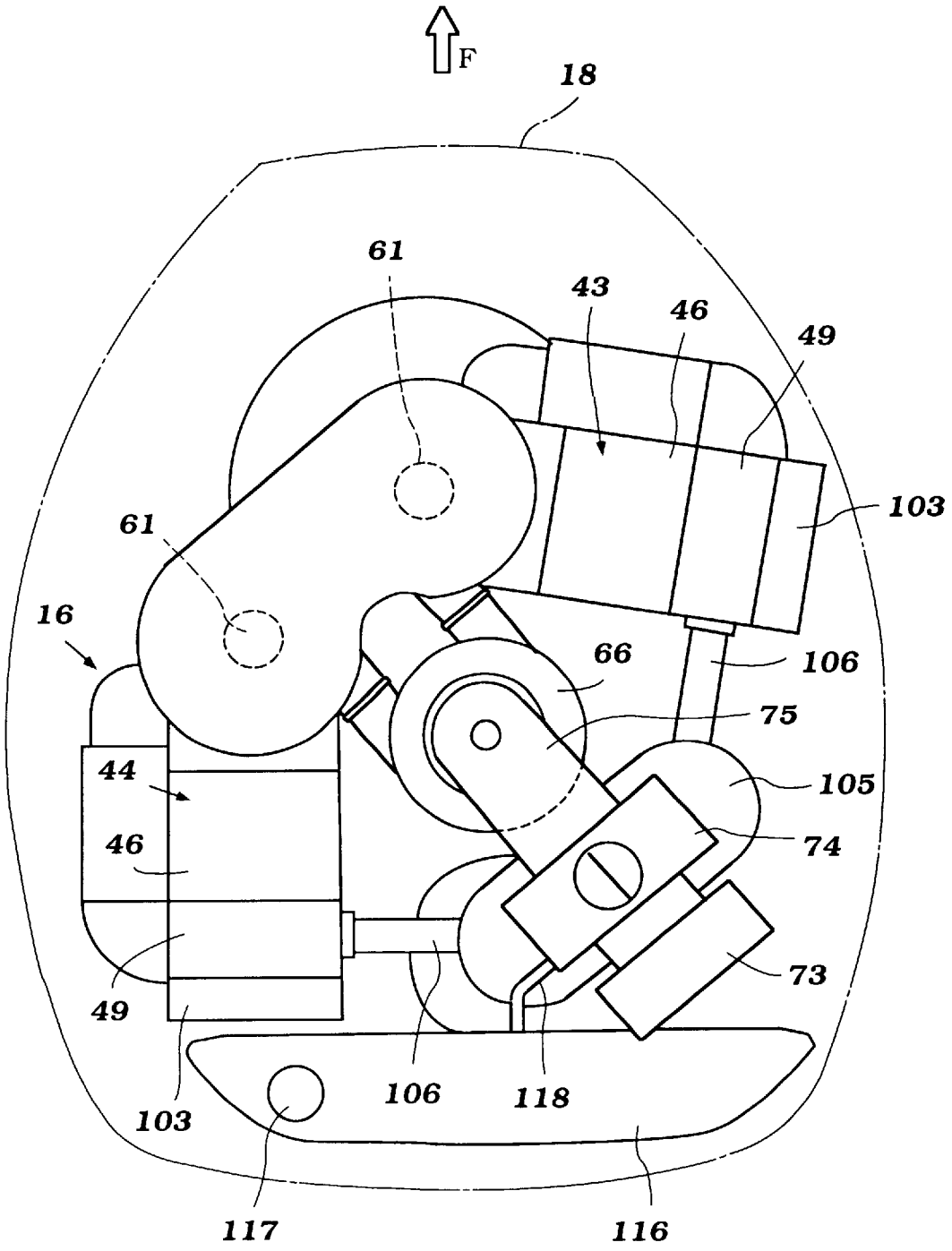
FIGS. 7 is a top plan view, in part similar to FIG. 3, and shows another embodiment of the invention.
Figure 8:
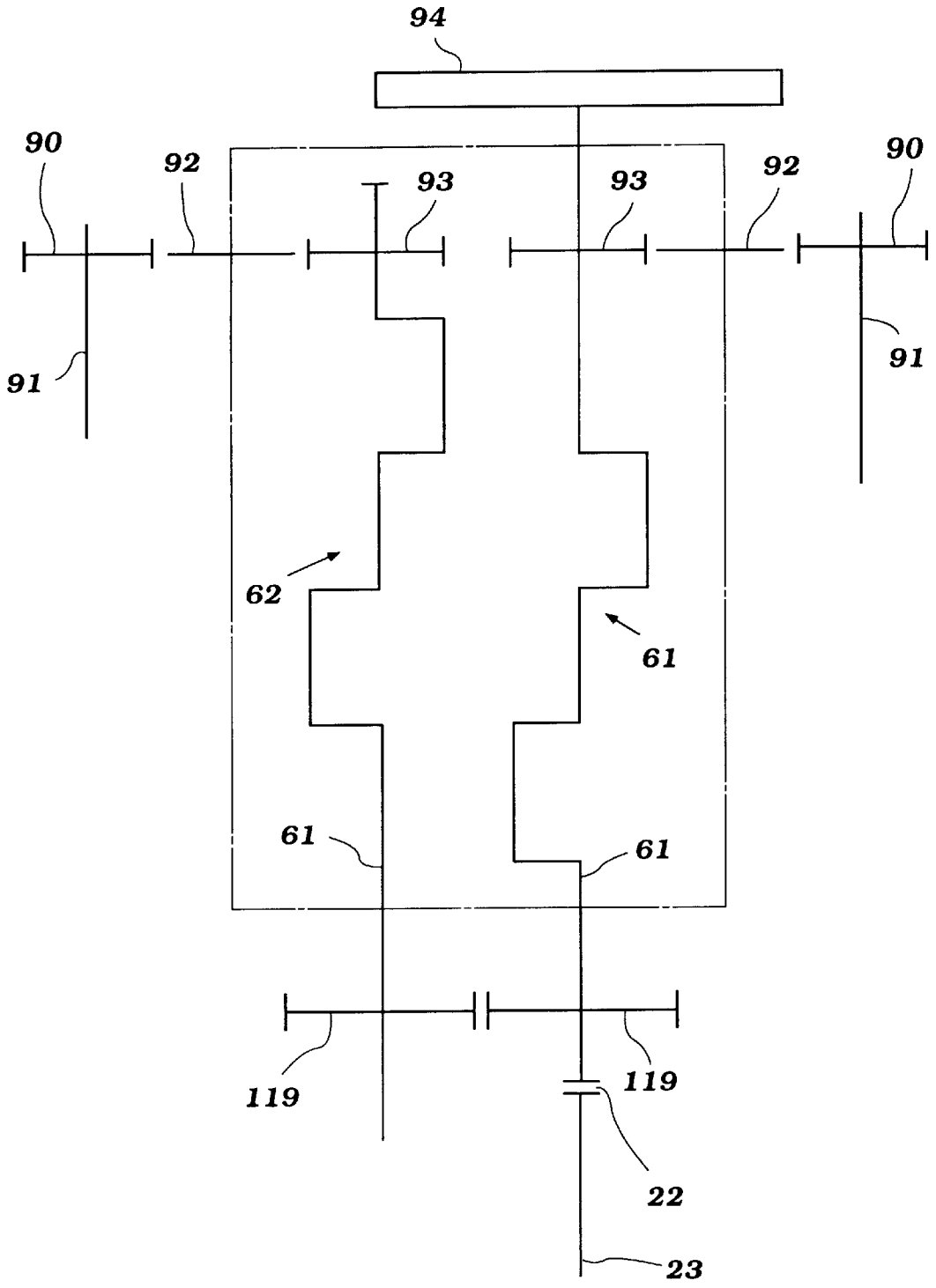
FIG. 8 is a schematic view, in part similar to FIGS. 6, and shows how the crankshafts are coupled to each other and to the drive shaft in this embodiment.

FIG. 7 and 8 show another embodiment of the invention which eliminates the necessity of having this timing drive. In this embodiment, the engine 16, which has the same general configuration as previously described, is rotated through an angle so that one cylinder bank 76 extends longitudinally and the other cylinder bank extends at an angle. In this way, one of the crankshafts 61 is coaxially aligned with the drive shaft 23 and may be directly to it as seen in FIG. 8. This arrangement requires some offsetting of the oil tank 116 relative to the exhaust collector section 105, but that presents no significant problem. Thus, from the foregoing description it should be readily apparent that the described embodiments of the invention provide very compact and nevertheless high output four-cycle engines because of their incorporation of crankcase compression and a V type configuration. Also, it should be readily apparent that the specific outboard motor applications are merely typical of the environments in which this compact engine construction may be utilized.

Of course, the foregoing description is that of preferred embodiments of the invention, and various changes and modifications may be made without departing from the spirit and scope of the invention, as defined by the appended claims.

What is claimed is:

1. A four cycle, V type, internal combustion engine comprised of a pair of cylinder blocks disposed at a V angle to each other and forming a valley therebetween, each of said cylinder block having at least one cylinder bore, a crankcase at one end of said cylinder bores and forming a plurality of crankcase chambers each associated with a respective cylinder bore, a pair of cylinder heads closing the other end of said cylinder blocks, a plurality of pistons each reciprocating in a respective one of said cylinder bores and forming with said cylinder bores and said cylinder heads a plurality of combustion chambers, crankshaft means rotatably journalled in said crankcase, a plurality of connecting rods each coupled to a respective one of said pistons and said crankshaft means for transmitting motion therebetween, means for providing a seal so that said pistons, said cylinder bores, said connecting rods, said crankshaft means and said crankcase chambers act as a plurality of positive displacement pumps, intake means for admitting an air charge to said crankcase chambers in said valley, delivery means for discharging a compressed air charge from said crankcase chambers at the other side of said valley, a pair of compressor chambers located at said other sides of said valley for receiving the compressed charge therefrom the respective crankcase chamber, each of said cylinder heads having at least one intake port on said other side of said valley for serving the respective of said combustion chambers, means for supplying a compressed charge from said compressor chamber to said intake ports entirely located on said other side of said valley, at least one exhaust passage formed in each of said cylinder heads contiguous to said valley for discharging exhaust products from said combustion chambers, and an exhaust manifold positioned at least in part in said valley for collecting the exhaust gasses from said exhaust passages.

2. A four cycle, V type, internal combustion engine as set forth in claim 1, wherein the crankshaft means comprises a pair of crankshafts each associated with the piston of one of the cylinder blocks.

3. A four cycle, V type, internal combustion engine as set forth in claim 2, wherein the crankshafts rotate in opposite directions.

4. A four cycle, V type, internal combustion engine as set forth in claim 3, further including transmission means joining the crankshafts for synchronizing their rotation.

5. A four cycle, V type, internal combustion engine as set forth in claim 1, wherein each cylinder block is formed with at least two cylinder bores.

6. A four cycle, V type, internal combustion engine as set forth in claim 1, wherein the intake means comprises a plenum chamber located entirely in the valley.

7. A four cycle, V type, internal combustion engine as set forth in claim 1, wherein the delivery means is intercooled.

8. A four cycle, V type, internal combustion engine as set forth in claim 7, wherein the intercoolers receive liquid coolant from a cooling jacket of the engine.

9. A four cycle, V type, internal combustion engine as set forth in claim 1, wherein the means for providing a seal comprises means for forming a seal between one end of each of said connecting rods and the respective one of said pistons and between the sides of said connecting rods and the side surfaces of the respective of said crankcase chambers, said connecting rods each having a portion thereof in sealing engagement with said crankcase during at least a portion of a single rotation of said crankshaft means.

10. A four cycle, V type, internal combustion engine as set forth in claim 1, wherein the intake means for admitting the air charge to the crankcase chamber comprises intake ports disposed in the valley of said engine and the delivery means for discharging a compressed charge from the crankcase chambers comprises discharge ports disposed on the outer sides of said engine.

11. A four cycle, V type, internal combustion engine as set forth in claim 10, wherein the crankshaft means comprises a pair of crankshafts each associated with the piston of one of the cylinder blocks.

12. A four cycle, V type, internal combustion engine as set forth in claim 11, wherein the crankshafts rotate in opposite directions.

13. A four cycle, V type, internal combustion engine as set forth in claim 12, further including transmission means joining the crankshafts for synchronizing their rotation.

14. A four cycle, V type, internal combustion engine as set forth in claim 13, wherein each cylinder block is formed with at least two cylinder bores.

15. A four cycle, V type, internal combustion engine as set forth in claim 14, wherein the intake means comprises a plenum chamber located entirely in the valley.

16. A four cycle, V type, internal combustion engine as set forth in claim 15, wherein the delivery means is intercooled.

17. A four cycle, V type, internal combustion engine as set forth in claim 16, wherein the intercoolers receive liquid coolant from a cooling jacket of the engine.

18. A four cycle, V type, internal combustion engine as set forth in claim 17, wherein at least one of the connecting rods and the crankshaft acts as a valve element for opening and closing one of said ports.

* * * * *